US008303352B2

(12) United States Patent
Hängärtner et al.

(10) Patent No.: US 8,303,352 B2
(45) Date of Patent: Nov. 6, 2012

(54) CONTACT CLIP

(75) Inventors: Georges Hängärtner, Courfaivre (CH); Pierre Lehmann, Courcelon (CH)

(73) Assignee: Preci Dip SA, Delemont (CH)

( * ) Notice: Subject to any disclaimer, the term of this patent is extended or adjusted under 35 U.S.C. 154(b) by 3 days.

(21) Appl. No.: 12/675,925

(22) PCT Filed: Sep. 3, 2008

(86) PCT No.: PCT/CH2008/000365

§ 371 (c)(1),
(2), (4) Date: Sep. 10, 2010

(87) PCT Pub. No.: WO2009/030057

PCT Pub. Date: Mar. 12, 2009

(65) Prior Publication Data

US 2011/0028039 A1 Feb. 3, 2011

(30) Foreign Application Priority Data

Sep. 5, 2007 (CH) ..... 1384/07

(51) Int. Cl.
*H01R 11/22* (2006.01)

(52) U.S. Cl. ..... 439/852; 439/843

(58) Field of Classification Search ..... 439/843–847, 439/851–854

See application file for complete search history.

(56) References Cited

U.S. PATENT DOCUMENTS 2,716,744 A * 8/1955 Kokalas et al. ..... 439/847
2,763,848 A * 9/1956 Tuchel ..... 439/852
3,120,418 A * 2/1964 Deakin ..... 439/560
3,120,989 A * 2/1964 Solorow et al. ..... 439/843
3,123,429 A * 3/1964 Anderson et al. ..... 439/843
3,218,606 A * 11/1965 Schultz ..... 439/844
3,237,149 A * 2/1966 West ..... 439/844
3,323,101 A * 5/1967 Eickmier ..... 439/843
3,381,262 A * 4/1968 Jeanrenaud ..... 439/843
3,396,359 A 8/1968 Melanson
3,409,863 A * 11/1968 Culver ..... 439/744
3,862,792 A * 1/1975 Jayne ..... 439/733.1
4,002,400 A * 1/1977 Evans ..... 439/748
4,189,204 A * 2/1980 Brown et al. ..... 439/846
4,401,359 A * 8/1983 Frelk ..... 439/846
4,550,972 A * 11/1985 Romak ..... 439/839
4,784,622 A * 11/1988 Senor ..... 439/853
4,840,587 A * 6/1989 Lancella ..... 439/851
5,082,462 A * 1/1992 Oswald, Jr. ..... 439/851
5,083,927 A * 1/1992 Herard et al. ..... 439/80
5,088,942 A * 2/1992 Welsh et al. ..... 439/843

(Continued)

FOREIGN PATENT DOCUMENTS

DE 9114433.7 3/1993

(Continued)

*Primary Examiner* — Ross Gushi

(74) *Attorney, Agent, or Firm* — Woodard, Emhardt, Moriarty, McNett & Henry LLP

(57) ABSTRACT

The contact clip according to the invention comprises a contact portion (11) comprising two elastic blades (15) capable of pressing a male contact portion (2) against an interior cylindrical portion (110) of the said contact portion. In view of the elongate shape of this contact portion, electrical contact between the contact clip and the male contact piece portion is had over a large surface area, thus reducing the contact resistance and the heating when high currents are passed. The contact clip further comprises an attachment portion (10) and possibly an end portion (12) and is intended to be fitted inside a hollow housing of a female contact piece (3).

10 Claims, 1 Drawing Sheet

U.S. PATENT DOCUMENTS

| | | | | | |
|---|---|---|---|---|---|
| 5,147,229 | A * | 9/1992 | Nestor | 439/843 |
| 5,256,088 | A * | 10/1993 | Lu et al. | 439/851 |
| 5,326,288 | A * | 7/1994 | Lu et al. | 439/851 |
| 5,529,517 | A * | 6/1996 | Hopf et al. | 439/843 |
| 5,551,897 | A * | 9/1996 | Alwine | 439/850 |
| 5,591,039 | A * | 1/1997 | Matthews | 439/181 |
| 5,601,457 | A * | 2/1997 | Le Gall | 439/843 |
| 5,613,885 | A * | 3/1997 | Plate et al. | 439/843 |
| 5,651,705 | A * | 7/1997 | Hsu | 439/852 |
| 5,667,413 | A * | 9/1997 | Trafton | 439/843 |
| 5,775,961 | A * | 7/1998 | Myer et al. | 439/843 |
| 5,810,627 | A * | 9/1998 | Gierut et al. | 439/843 |
| 6,086,434 | A * | 7/2000 | Rollero et al. | 439/852 |
| 6,250,974 | B1 * | 6/2001 | Kerek | 439/843 |
| 6,264,508 | B1 * | 7/2001 | Lehmann | 439/843 |
| 6,354,890 | B2 * | 3/2002 | Adkins et al. | 439/843 |
| 6,358,104 | B2 * | 3/2002 | Daugherty et al. | 439/851 |
| 6,425,786 | B1 * | 7/2002 | Scholler | 439/843 |
| 6,475,039 | B1 * | 11/2002 | Despouys | 439/843 |
| 6,638,116 | B2 * | 10/2003 | Byron et al. | 439/843 |
| 6,811,453 | B2 * | 11/2004 | Williams | 439/843 |
| 6,860,768 | B2 * | 3/2005 | Zhao | 439/852 |
| 6,945,830 | B2 * | 9/2005 | Copper et al. | 439/852 |
| 7,048,597 | B2 * | 5/2006 | Chen | 439/851 |
| 7,462,078 | B2 * | 12/2008 | Mao | 439/843 |
| 2002/0013099 | A1 | 1/2002 | Adkins et al. | |
| 2007/0190868 | A1 * | 8/2007 | De Cloet et al. | 439/851 |

FOREIGN PATENT DOCUMENTS

| | | |
|---|---|---|
| EP | 1107378 | 6/2003 |
| FR | 2301931 | 9/1976 |
| FR | 2701170 | 8/1994 |

* cited by examiner

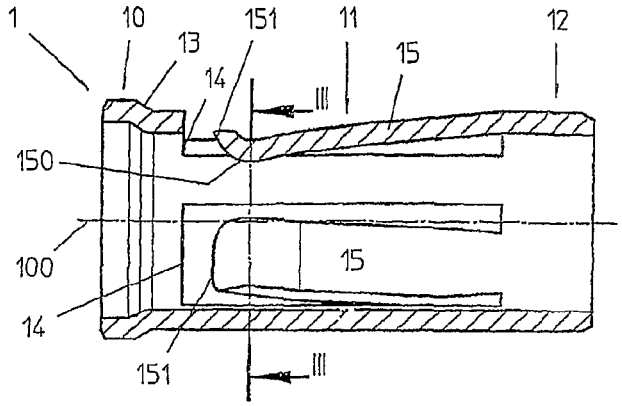
Fig. 1
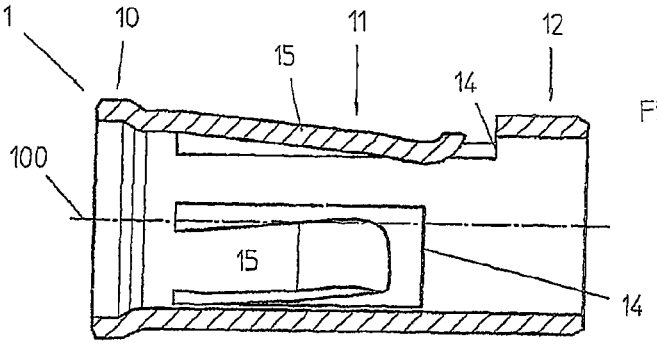
Fig. 2
Fig. 3
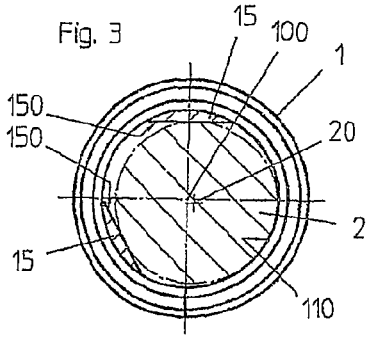
Fig. 4
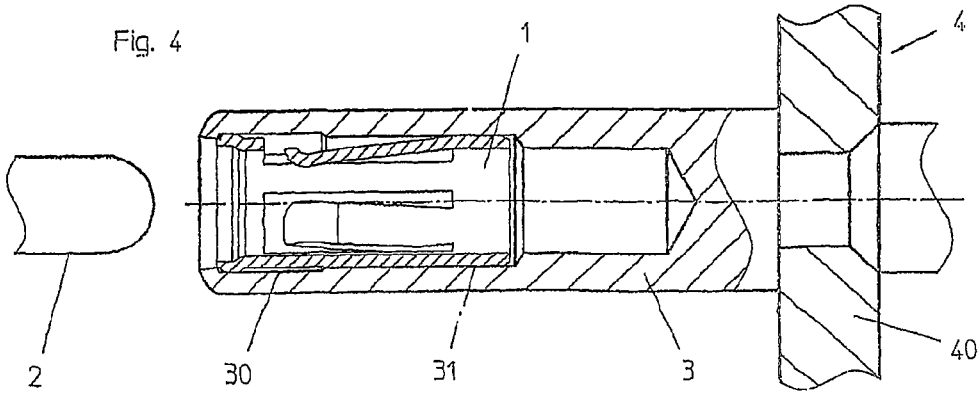

CONTACT CLIP

REFERENCE TO RELATED APPLICATIONS

This application is the U.S. nationalization of PCT/CH2008/000365, filed 3 Sep. 2008. This application claims priority from Patent Application No. CH 1384/07, filed 5 Sep. 2007.

The present invention concerns a contact clip designed to be introduced inside a contact piece of female type to complete the latter, said contact clip ensuring electrical contact between said female contact piece and a corresponding contact piece of male type. The invention also concerns a contact piece equipped with such a contact clip as well as a connector fitted with at least one such contact piece.

The application EP 1 107 378 describes a contact piece of female type equipped with a contact clip provided to be installed on a multi-contact connector. The disadvantage of contact clips such as described in this document is that the contact surface they exhibit with the contact male piece when the latter is introduced is relatively limited, involving relatively high contact resistance, according limiting the value of the current which is possible to have sent by such a set of contacts to prevent prohibitive heating of the set of contacts.

Other technical considerations must be respected to produce a contact clip, respectively a contact piece having the preferred characteristics. Given that such contact pieces are generally arranged in multi-contact connectors or on printed circuit boards, their dimensions must be highly reduced since, for example on a connector, the distance between the axes of two successive contact pieces can be less than $1/10^{th}$ of an inch (2.54 mm). Also, the male and female contact pieces can often be connected or disconnected, implying that the elasticity of the contact clip is sufficient to continue ensuring proper contact after numerous connections and disconnections and guarantee constancy of insertion and extraction forces of the male contact piece in the corresponding female piece. Also, the contact clip does not have to preferably have any ridge or roughness likely to damage the external contact surface of the male piece during introduction or extraction.

An initial aim of the invention is therefore to propose a contact clip improved relative to those known from the prior art.

Another aim of the invention is to propose a contact clip capable of enabling transit of current higher than known contact clips, without excessive heating of the contact pieces.

Another aim of the invention is to propose a contact clip whereof the mechanical qualities will not deteriorate after extended use over time.

Yet another aim of the invention is to propose a contact piece of female type equipped with such a contact clip, capable of cooperating with a contact piece of male type, without harming the contact surface of the latter.

Finally, yet another aim of the invention is to propose a connector fitted with at least one contact piece of female type comprising a contact clip as defined hereinabove.

Two embodiments of the invention are described in greater detail hereinbelow, this description being considered in light of the attached drawing comprising figures, in which:

FIG. 1 is a longitudinal section of a contact clip according to a first embodiment of the invention, FIG. 2 is a longitudinal section of a contact clip according to a second embodiment of the invention, FIG. 3 is a longitudinal section of the contact clip according to FIG. 1, according to the line of FIG. 1, FIG. 4 is a longitudinal section of a connector portion showing a portion of a contact piece fitted with a contact clip.

The contact clip 1, as shown in FIG. 1 has an essentially tubular form, comprising a fixing portion 10, a contact portion 11 and an end portion 12 in the direction of length and from left to right in the embodiment of FIG. 1.

The fixing portion 10 consists of an annular cylindrical portion designed to affix the clip 1 in a corresponding portion of a contact piece, as will become evident later. The significant dimensional length of this fixing portion 10 is therefore its external diameter. Given that to fix the fixing portion 10 in the contact piece, it is necessary in the illustrated embodiment for the external diameter of said fixing portion to be greater than that of the other portions, a truncated portion 13 connects the diameters.

The end portion 12, arranged, in the embodiment illustrated, at the opposite end of the clip, consists of a tubular cylindrical portion designed to be inserted into a corresponding guide portion of a contact piece, as will be made evident later. For this portion 12 also, the significant dimensional length is its external diameter.

The central portion of the clip 1, forming the contact portion 11, and constituted by a tubular cylindrical portion, here of identical diameter to that of the end portion 12, in which a certain number of cutouts 14 has been arranged, two in the embodiment shown, each cutout 14 comprising an elastic blade 15.

Each cutout 14, respectively each elastic blade 15, is fashioned in the longitudinal direction of the clip 1.

As is evident from FIG. 3, the two elastic blades 15 have been deformed, being slightly bent in the direction of the central longitudinal axis 100 of the clip 1. When a male portion 2 of a contact piece, shown in section in FIG. 3 though not illustrated in the other figures, was introduced to the clip 1, it is pressed by the two elastic blades 15, each applying radial force to the male portion 2, pressing it against the portion of inner cylindrical surface 110 opposite the elastic blades 15, of the contact portion 11. It is therefore evident, particularly in FIG. 3, that the longitudinal axis 20 of the male portion 2 is offset relative to the longitudinal axis 100 of the clip 1, consequently increasing the surfaces of the male portion 2 as well as of the clip 1 in electrical contact, these surfaces essentially comprising the portion of inner cylindrical surface 110 mentioned earlier, as well as the two inner surfaces 150 of the elastic blades 15. In a contact clip such as described here, the contact surface also depends on the length of the contact portion 11, a parameter which is generally not considered in clips of this type according to the prior art. These contact surfaces are therefore clearly larger than the corresponding surfaces of contact clips of the prior art.

FIG. 1 shows that the free end 151 of each elastic blade 15 is curved slightly towards the outside of the clip 1 so as not to damage the external contact surface of the male portion 2 when introduced into the clip 1.

In the embodiment of the clip 1 shown in FIG. 1, the free end 151 of each elastic blade 15 is directed towards the front of the clip 1, or in the direction of the fixing portion 1, whereas in the embodiment of the clip 1 shown in FIG. 2 the free end 151 of each elastic blade 15 is directed towards the bottom of the clip 1, or in the direction of the end portion 12.

Another difference visible in FIG. 2 is that the blades 15 are of different lengths, enabling both a decrease in the insertion force of the male piece 2 and also better distribution of the support force of the male piece 2 on the portion of inner cylindrical contact surface 110 of the clip 1.

Apart from these particular differences, the two clips 1 of FIGS. 1 and 2 are similar and work in the same way.

It is evident that construction with blades 15 of different lengths can also be adapted to a clip such as illustrated in FIG. 1.

The material used for such contact clips is preferably an alloy of copper and beryllium known for its fine electrical and mechanical qualities.

Such clips are preferably manufactured from strips of the material making up the clips by cutting out via stamping then rolling.

FIG. 4 shows a section of a portion of connector 4 comprising a contact piece of female type 3, fitted with a contact clip 1, ready to receive a contact portion of male piece 2.

The part of the contact piece 3 designed to receive the clip 1 is essentially cylindrical in shape and comprises an axial blind bore comprising, in the embodiment shown, a first fixing bearing 30 designed to receive the fixing portion 10 of the clip, a central bearing 31 designed to receive the contact portion 11 of the clip as well as the end portion 12 of the clip. In the embodiment shown, the bearings 30 and 31 have different diameters.

The clip 1 is introduced into the housing axial of the contact piece 3 by first introducing the end portion 12, then the contact portion 11 via the opening of the housing, these two portions easily passing through the fixing bearing 30 of greater diameter. The external diameter of the fixing portion 10 of the clip corresponds to the inner diameter of the fixing bearing 30 of the contact piece 3, such that the clip 1 remains fixed in the piece 3 after introduction and pressing, crimping or fixing of the fixing portion 10 in the fixing bearing 30 by any known means. When the clip is mounted in the contact piece as described hereinabove, the end portion 12 finally is housed in the central bearing 31.

Electrical contact, respectively passage of the electric current between the contact clip 1 and the contact piece of female type 3, occurs essentially via the uncut part of the contact portion 11 corresponding to the surface portion 110 seen previously and the end portion 12 with the central bearing 31.

The rest of the contact piece 3, just sketched in FIG. 4, can be of any known type for this type of contact piece, and can for example comprise a portion in which a wire can be crimped, screwed or welded, or a fixing portion on a connector or a printed circuit or a second portion in the form of a female contact, to form a transition contact piece, etc.

FIG. 4 shows the contact portion of piece 3 described hereinabove mounted on an insulating plate 40 of a connector 4, only a portion of which is shown here.

Given that by the construction described hereinabove, the mechanical stresses, especially those of elasticity, are exerted on the contact clip 1, the contact piece 3 is to be made preferably from a material of reduced cost, brass for example, which is an additional advantage of this type of construction. If needed, only the contact clip 1 will undergo surface treatment, thus improving its electrical contact qualities.

The foregoing description concerns two preferred embodiments of the invention, such as shown in the figures; different variants of execution or construction can be envisaged.

For example, to lower the cost of the clip 1 it is possible to omit the end portion 12, with the contact portion 11 ensuring guidance of the clip during its introduction into the contact piece.

Similarly, clips 1 have been described, each comprising two elastic blades 15. Each clip 1 could comprise a number of elastic blades 15, more than two, given that the positioning of these blades 15 on the periphery of the contact portion 11 is significant, since these blades must each exert radial force such that the component of the sum of these radial forces applied to the male piece 2 offsets its longitudinal axis 20 and presses said male piece 2 against a portion of the inner cylindrical surface 110 free of elastic blade 15. These elastic blades 15 will therefore be arranged irregularly over the periphery of the contact portion 11. The choice will be made to preferably have at least two elastic blades 15 to give stable positioning of the male piece 2 inside the clip 1.

Due to its large contact surface with the male contact piece which it grips, a contact clip 1, such as described hereinabove according to one or other of its embodiments, has low contact resistance, allowing passage of relatively strong currents, without overheating. It can be made in a very small size, enabling its integration into a small-sized contact piece, a plurality of said contact pieces able to be assembled to form a connector, or the contact pieces can be mounted directly on an insulating plate of a printed circuit.

The invention claimed is:

1. An electrical connector comprising a contact clip, a contact piece of female type and a contact piece of male type, wherein the contact clip is used with the contact piece of female type to ensure electrical contact between said contact piece of female type and said contact piece of male type of cylindrical form introduced therein, wherein the contact clip comprises especially a contact portion and a fixing portion, arranged longitudinally behind one another, at least two longitudinal elastic blades being arranged in two longitudinal cutouts of said contact portion, said elastic blades pressing said contact piece of male type against an inner surface portion of said contact portion opposite said elastic blades, wherein the elastic blades are arranged irregularly on the periphery of said clip to leave an inner surface portion free of elastic blade, said inner surface portion constituting the principal surface of electrical contact between the male portion and the clip.

2. The electrical connector as claimed in claim 1, wherein the elastic blades press the male portion against the inner surface portion by offsetting a longitudinal axis of said male portion with respect to a longitudinal axis of the clip.

3. The electrical connector as claimed in claim 1, wherein the fixing portion is constituted by an annular portion provided to be fixed in a cylindrical bearing of a housing hollow axial of the contact piece.

4. The electrical connector as claimed in claim 1, wherein it further comprises an end portion arranged on the other side of the contact portion to the fixing portion, constituted by a cylindrical portion capable of being introduced into a guide bearing of said hollow housing axial to the contact piece.

5. The electrical connector as claimed in claim 1, wherein the elastic blades are directed towards the portion opposite the fixing portion.

6. The electrical connector as claimed in claim 1, wherein the elastic blades are directed towards the fixing portion.

7. The electrical connector as claimed in claim 1, wherein the elastic blades are of identical length.

8. The electrical connector as claimed in claim 1, wherein the elastic blades are of different lengths.

9. The electrical connector as claimed in claim 1, wherein the ends of the elastic blades are rounded and curved towards the outside.

10. The electrical connector as claimed in claim 1, wherein it the contact clip is made of an alloy of copper and beryllium.

* * * * *